US009525954B2

(12) United States Patent
Nystrom et al.

(10) Patent No.: US 9,525,954 B2
(45) Date of Patent: Dec. 20, 2016

(54) AUDIO DEVICE AND AUDIO PRODUCING METHOD

(75) Inventors: Martin Nystrom, Horja (SE); Sead Smailagic, Helsingborg (SE)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 485 days.

(21) Appl. No.: 13/472,889

(22) Filed: May 16, 2012

(65) Prior Publication Data

US 2013/0044888 A1 Feb. 21, 2013

Related U.S. Application Data

(60) Provisional application No. 61/523,418, filed on Aug. 15, 2011.

(30) Foreign Application Priority Data

Aug. 15, 2011 (EP) ..... 11177538

(51) Int. Cl.
*H04R 29/00* (2006.01)
*H04S 7/00* (2006.01)

(52) U.S. Cl.
CPC ..... *H04R 29/001* (2013.01); *H04R 29/00* (2013.01); *H04S 7/301* (2013.01)

(58) Field of Classification Search
CPC ..... H04R 29/00; H04R 29/001; H04R 29/002; H04R 29/003; H04R 3/04; H04R 3/12; H04S 7/301
USPC ..... 381/59, 74, 309, 370, 381, 96
See application file for complete search history.

(56) References Cited

U.S. PATENT DOCUMENTS

2004/0081099 A1* 4/2004 Patterson et al. ..... 370/241
2011/0002471 A1* 1/2011 Wihardja et al. ..... 381/56
2011/0116643 A1* 5/2011 Tiscareno et al. ..... 381/58

FOREIGN PATENT DOCUMENTS

DE 10 2007 032281 A1 1/2009
WO 2004/001552 A2 12/2003

OTHER PUBLICATIONS

Extended European Search Report for application EP 11 17 7538, completion of search Apr. 24, 2012.

* cited by examiner

*Primary Examiner* — Xu Mei
(74) *Attorney, Agent, or Firm* — Renner, Otto, Boisselle & Sklar LLP.

(57) ABSTRACT

The invention relates to an audio device comprising:
an audio source arranged to produce audio signals;
an audio output arranged to connect at least one speaker with said audio device;
impedance calculation means arranged to calculate an impedance of said at least one speaker;
a speaker identification module arranged to determine the identity of said at least one speaker using said impedance and identification data relating to one or more reference speakers. Once the identity of a speaker is known, it can be used for audio compensation or marketing information.

11 Claims, 5 Drawing Sheets

AUDIO DEVICE AND AUDIO PRODUCING METHOD

TECHNICAL FIELD

The present invention relates generally to audio devices, and more particularly to audio devices which use external speakers such as a headset.

BACKGROUND

Audio devices, especially portable ones, have been popular for decades yet continue to increase in popularity. Many modern portable audio devices are intended or suitable for recording or playback of acoustic and/or video signals. For example, portable CD or DVD players, MPEG players, MP-3 players, etc. provide a vast variety of forms of personal entertainment.

Similarly, portable electronic devices in the form of mobile phones, pagers, communicators, e.g., electronic organizers, personal digital assistants (PDAs), smart phones or the like are also increasingly popular. Such devices allow a user to communicate with others, store and manipulate data, create text, etc., many times within the same device.

For many portable audio devices, it is necessary or desirable to have a headset, the headset typically comprising one or more speakers, which may be in the form of one or two earplugs. Typical headsets are either wireless (e.g., Bluetooth or the like) or wired. By using a headset, a user of a mobile phone, for example, can enjoy more privacy such that the others around him or her cannot hear the telephone conversation. Further, by using a suitable microphone in the headset, a telephone call can still be successfully arrived at even though there may be much background noise.

There are a wide variety of headset types, including over-ear headsets, around-ear headsets, on ear headsets, in-concha headsets, in-ear headsets, etc. Each type of headset has advantages and disadvantages with regard to sound quality, ease of use, aesthetics, user comfort, etc.

Two popular headset designs, particularly for headsets used in connection with mobile phones, are the in-concha headset and the in-ear headset. The in-concha headset design generally includes a speaker that is, when properly positioned, received within the concha of the ear of a user (generally the area of the ear surrounding the opening of the ear canal). The in-ear headset design generally includes a speaker and/or insert that is at least partially received within the ear canal of a user when properly positioned. These designs are typically compact and are often supported by a small structure that is secured to the external portion of the ear (e.g., with an ear hook) and/or supported and/or retained within the ear by the concha or ear canal in what amounts to an interference fit.

Speakers, such as ear speakers, can be electrically connected to a standard interface of an audio device by means of 4 mm speaker terminals, or to 3.5 mm or 6 mm connectors. To these interfaces it is possible to connect almost any speakers and ear speakers from different brands and of different models. A drawback of the open standard interface is that the audio device has no knowledge of what speaker is connected, which may lead to poor audio quality. If any, compensation to enhance audio quality in the connected speaker must be handled manually.

SUMMARY OF THE INVENTION

With the above description in mind, then, an aspect of the present invention is to provide a way of determining the identity of a speaker connected to an audio device which seeks to mitigate, alleviate, or eliminate one or more of the above-identified deficiencies in the art and disadvantages singly or in any combination.

A first aspect of the present invention relates to an audio device comprising:

- an audio source arranged to produce audio signals;
- an audio output arranged to connect at least one speaker with the audio device;
- impedance calculation means arranged to calculate an impedance of the at least one speaker;
- a speaker identification module arranged to determine the identity of the at least one speaker using the impedance and identification data relating to one or more reference speakers.

Once the identity of a connected speaker is known to the audio device, it can be used for audio compensation within the audio device. Alternatively, it could be used as marketing/sales information useful for a service provider and/or a manufacturer of the audio device or the speaker.

The audio device may be a mobile phone, a PDA, a portable CD or DVD players, or any other device producing audio. The device may be a hand held audio device as well as a non-portable device such as stationary music equipment connectable to professional audio like concert speakers etc. The identity of the speaker connected to the audio device may comprise information relating to the type of speaker (e.g. in-ear), to a specific manufacturer and model (e.g. SonyEricsson—MH 700), or any other data that could be used to identify a speaker.

In an embodiment, the audio device further comprises audio processing means arranged to process the audio signals depending on the identity of the speaker. The audio processing means may comprise a spectral filter for filtering the audio signals so as to improve the experienced audio quality.

In an embodiment, the device further comprises measuring means for measuring low frequency responses, and messaging means for creating an audio message in case the low frequency responses indicate a poor fit of the at least one speaker in a users ear. In this way a user can be alerted and asked to better fit an ear speaker.

In an embodiment, the device further comprises storing means arranged to store the identification data. By storing the identification information within storing means in the audio device, the information is directly available to e.g. a processor arranged to perform the identification.

The device may further comprise receiving means arranged to receive at least part of the identification data of the reference speakers from a remote server. In this way, the audio device can determine the identity of a connected speaker using up-to-date information. This is particularly useful when a relatively new speaker is connected, which was not yet know to the audio device. Together with the identification information the audio device could also receive and use compensation data which can for example be used to optimize the audio quality for certain speakers.

In an embodiment, the device further comprises sending means arranged to send the speaker identity to a remote server. This server may then store the information on the connected speaker. Such a server could be arranged to store such information for a predefined group of speakers, or a predefined group of audio devices. This gathered information could be useful marketing and sales information for the provider and/or the manufacturers.

In an embodiment, the device further comprises a resistor electronically connected between the audio source and the audio output, wherein the impedance calculation means are arranged to measure a voltage across and a current through the resistor. Since the current through the resistor is the current through the speaker, the impedance of speaker can be determined using the known impedance of resistor.

In a particular embodiment, the audio device is a mobile phone. The mobile phone could be arranged to output received audio messages, but it could also be arranged to produce audio from an internal audio player.

According to a further aspect of the invention, there is provided an audio producing method comprising:

- producing audio signals using an audio source;
- outputting audio via a output to at least one connected speaker;
- calculating an impedance of the at least one connected speaker.
- identifying the at least one connected speaker using the impedance and identification data relating to one or more reference speakers.

The method further may comprise the compensation of the audio by processing the audio signals depending on the impedance of the at least one connected speaker.

BRIEF DESCRIPTION OF THE DRAWINGS

Further objects, features, and advantages of the present invention will appear from the following detailed description of some embodiments of the invention, wherein some embodiments of the invention will be described in more detail with reference to the accompanying drawings, in which.

DETAILED DESCRIPTION

Figure 1:
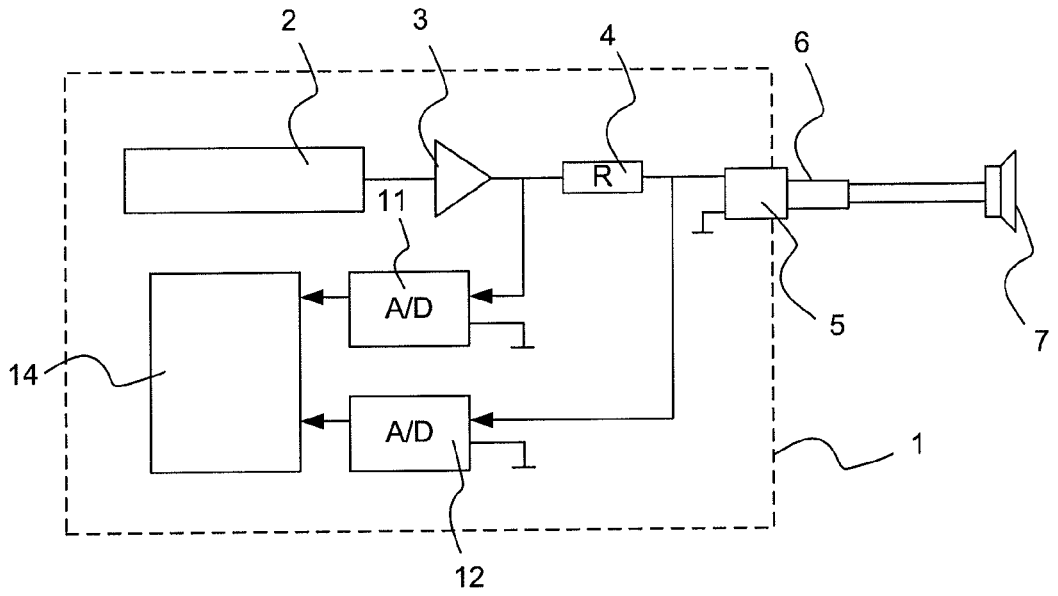
FIG. 1 schematically shows an embodiment of the present invention.

FIG. 1 schematically shows an embodiment of the present invention in which an audio device 1 comprises an audio source, e.g a music player 2, and an amplifier 3 connected at an output of the audio source 2. At its output, the amplifier 3 is connected to a resistor 4 which in turn is connected to an audio output 5. In FIG. 1, a connector 6 is inserted into the audio output 5 so as to connect a speaker 7 with the audio device 1. The speaker 7 may be one of the speakers of a headset. Electrical wires 8 connect the connector 6 with the speaker 7. The audio device 1 further comprises a first and second A/D converter, see 11 and 12, one of their inputs being connected at either side of the resistor 4. The outputs of the A/D convertors 11, 12 are connected to a processor 14. The processor 14 according to an embodiment is arranged to determine a voltage $V_R$ over the resistor 4 (which is the voltage in A/D convertor 11 minus the voltage in A/D convertor 12) and divide that voltage by the known resistor value R to render the current through the resistor 4 $I_R$ and thus through the speaker 5. The impedance of the speaker 7 is calculated by dividing the voltage over the speaker $V_S$, measured by A/D convertor 12, and divide that voltage $V_S$ by the current $I_R$ though the speaker. The impedance of the speaker 7 is frequency dependent, and has a complex value (meaning it has a magnitude and a phase).

In an embodiment, the audio device 1 is a mobile phone. It is noted that there already is a resistor connected to the audio output in many mobile phones today, which is mainly used for short circuit protection. A typical value for such a resistor is 10 Ohms. That resistor may be used as resistor 4 for the impedance measurements of the connected speaker as described with reference to FIG. 1. Furthermore, the microphone A/D converters of the mobile phone, or the line in A/D converters could be used for the convertors 11, 12. As a measurement signal, a short noise signal at connect could be used, or, the music signal at ordinary playback could be used. By using the modules already present in the modern mobile platforms, no new hardware is needed.

In an embodiment, the processor 14 is arranged to make a distinction between an in-ear and in-concha ear speaker. This distinction is made by testing whether the frequency of the main resonance peak is low or high. A typical in-concha ear speaker has a resonance around 100 Hz, and the in ear speaker has a typical resonance of 3000 Hz. To find the resonance peaks the impedance can be measured, giving a vector with value of magnitude and phase for each measured frequency band. The resonance peak is where the impedance reaches a local maximum. According to an embodiment, the position—in frequency—of these peaks is used for the identification of what device is connected.

To distinguish between a in-ear and in-concha ear speaker is advantageous because it can be used for compensation of the frequency response. An in-concha ear speaker will have a bass cut-off from the resonance frequency and lower.

According to an embodiment, once it is determined by an algorithm loaded in the processor 14 that an in-concha ear speaker is connected to the audio device 1, the processor 14 will activate a suitable filter, not shown in FIG. 1. The result can be a richer, more full bodied sound from an in-concha ear speaker.

If an in-ear speaker is fitted well, the speaker works towards a closed cavity, the ear canal. If the in-ear speaker is fitted poorly (i.e. loosely), there will be leakage. This will affect the low frequency reproduction. Impedance wise, a closed cavity will give a radiation impedance for the speaker into an air spring, the closed cavity. If the speaker 7 radiates into a free field it will have a resistive radiation impedance of the transmitted sound wave. The difference in acoustic radiation impedance is also present in the electric impedance measurements. The detection if a speaker is fitted properly in a corresponding ear, can be done by correlating a measured vector with one or more stored vectors of, e.g. an ear speaker fitted perfectly, semi-loosely and with poor, leaky fit. Depending on which one of these stored vectors gives the best correlation to the measured impedance vector, the conclusion of how well fitted the ear speaker is, can be made. In an embodiment, the processor 14 is arranged to determine a poor bass response by measuring the impedance as a function of frequency. In an embodiment, in case the low frequency responses indicate a poor fit of the ear speaker, messaging means will create an audio message to inform the user to fit the earpiece tighter. These messaging means may be arranged as an algorithm running on the processor 14, or it may be separated messaging means arranged to communicate with the processor 14. Alternatively, compensation means 30 may be arranged in the audio device 1, to compensate for the lost low frequency response.

Figure 2:
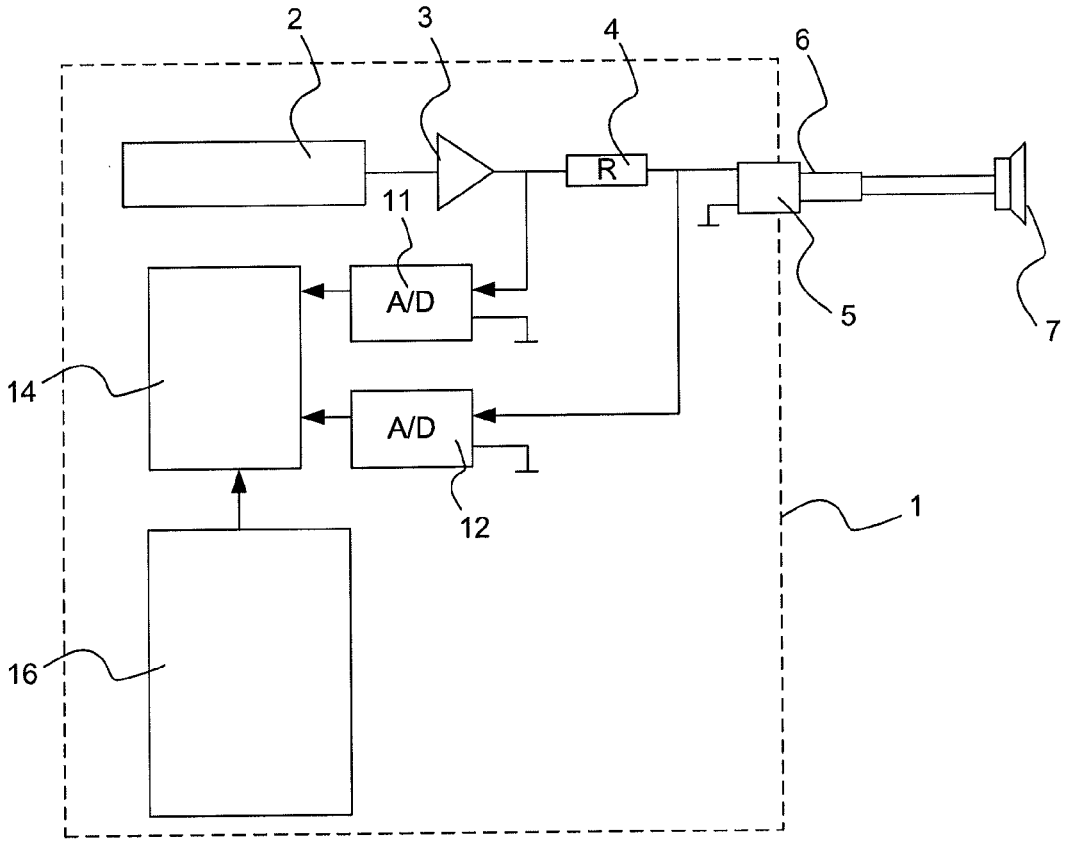
FIG. 2 schematically shows a further embodiment of the present invention in which the audio device also comprises a storage.

The ear speaker recognition process is dependent on the resolution. Once it is exactly known what product is connected to the audio device 1, more specific audio compensations can be performed to further optimize the audio experience for the user. To distinguish exactly which product is connected the processor 14 may be arranged to correlate the measured impedance towards a library of references. FIG. 2 schematically shows a further embodiment of the present invention in which the audio device 1 also comprises a storage 16 arranged to store a reference library of impedances. In this embodiment, the processor 14 is arranged to compare a measured impedance with reference impedances stored in the reference library. The library could be stored in the storage 15 permanent or upgradeable. Alternatively, it could be a service in a server, placed somewhere in a network reachable by phone or playing device. The reference library may comprise a table with a list of speaker id's and their identification data (e.g. type and name of manufacturer) and their specific impedance profile (i.e. the impedance 'fingerprint').

Figure 3:
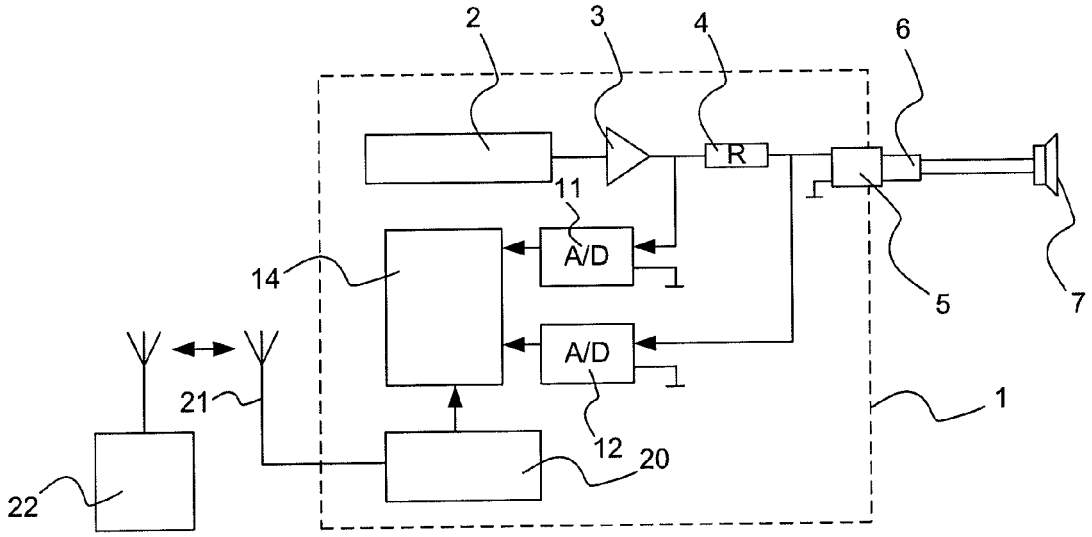
FIG. 3 schematically shows an embodiment of the audio device wherein the device comprises a communication means.

FIG. 3 schematically shows an embodiment of the audio device 1 wherein the device comprises a communication means 20 connected to an antenna 21. The communication means 20 are arranged to receive information from a remote server 22. In an embodiment, the communication means comprise both a sender and a receiver. The antenna 21 may be the normal antenna of a mobile phone, or it may be a dedicated antenna, used to receive information from the sender relating to reference speakers. Once a connection is established with the remote server 22, the communication means may receive identification information relating to one or more reference speakers together with impedance information for these speakers. This information will be stored in the storage 16 shown in FIG. 2.

If the audio device is lacking a wireless communication option, communication with a remote server may be performed using a wired connection. For example, stationary devices like home stereo etc, could be connected to the server 22 using wired connection like a standard wired internet connection.

Figure 4:
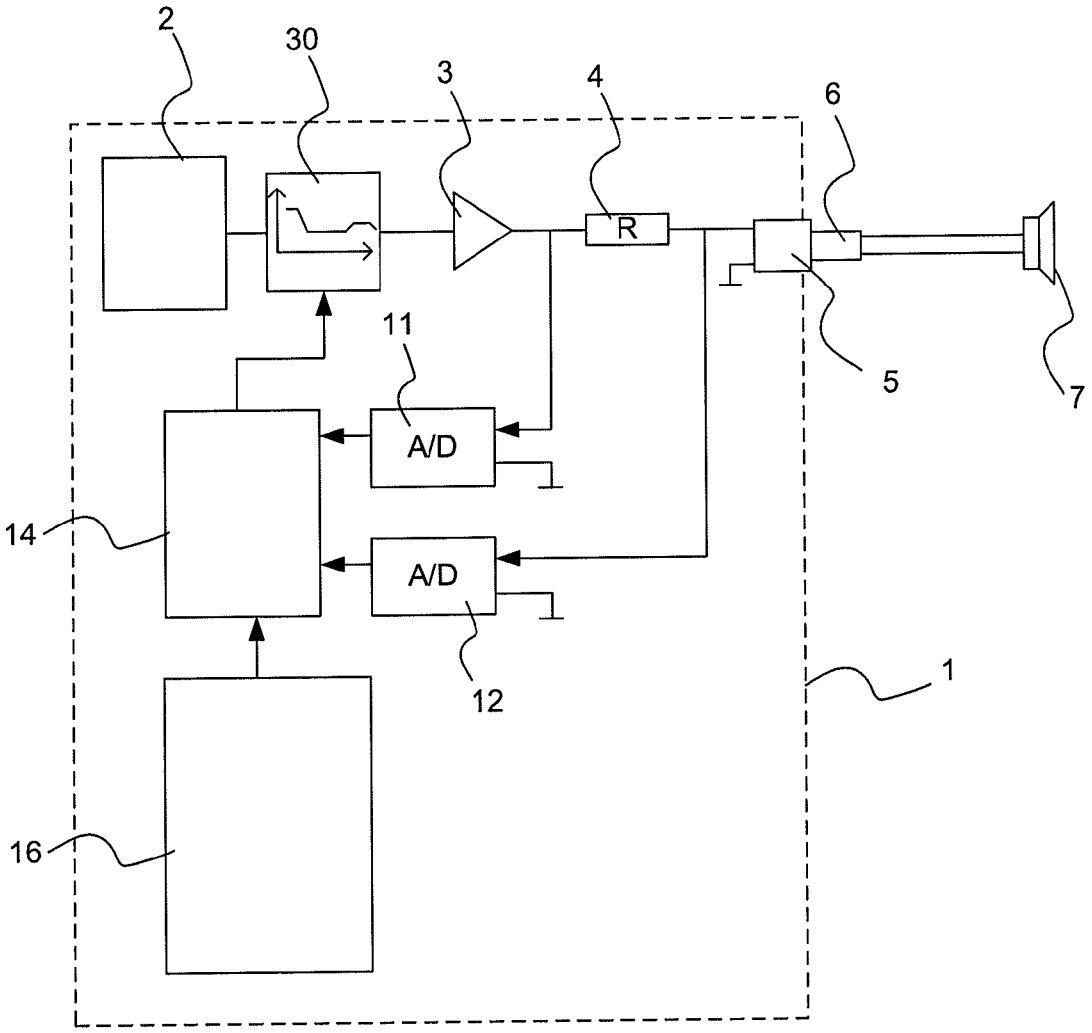
FIG. 4 schematically shows a further embodiment of the audio device.

In an embodiment, the audio device 1 comprises a compensation means 30, see FIG. 4. The compensation means 30 may comprise a filter arranged to compensate for the low frequency cut off of an in-concha ear speaker, resulting in a richer experience for the user. It should be noted that other types of compensations are possible. Other specific audio compensation could be any selected amplitude and/or phase filtering added in the signal chain before the audio is sent to the speaker 7. Then the final result, compensation and speaker together will give an enhanced performance. Examples of such a compensation are a little bass lift for in-concha speakers (as mentioned above), attenuation of a resonance peak in a well known ear speaker, etc.

The compensation means 20 may be some electric filtering—digital or analogue—, aimed to compensate for a shortcoming in the speaker connected. If an amplifier is present in the audio device, the compensation means 20 are preferably placed after the audio source (e.g. music player) and before the power amplifier 3.

Figure 5:
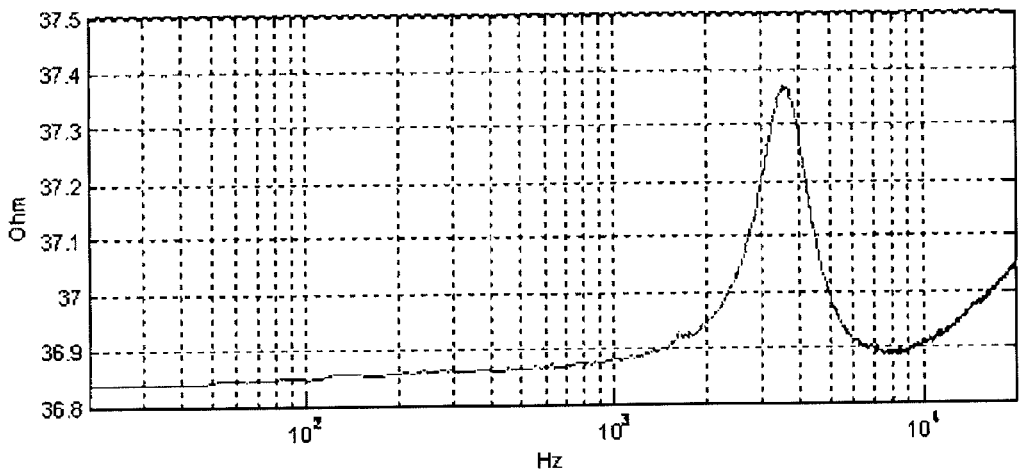
FIG. 5-8 show the impedance as a function of frequency for several different speakers.
Figure 6:
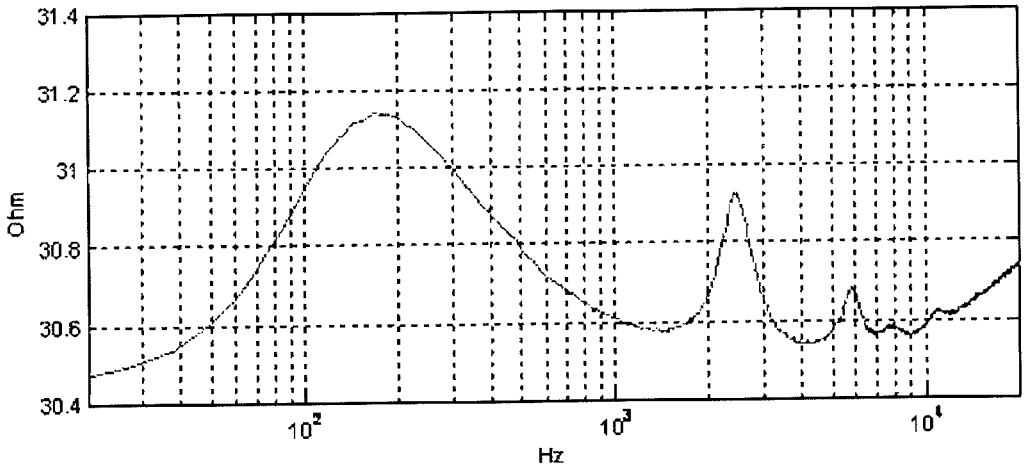
Figure 7:
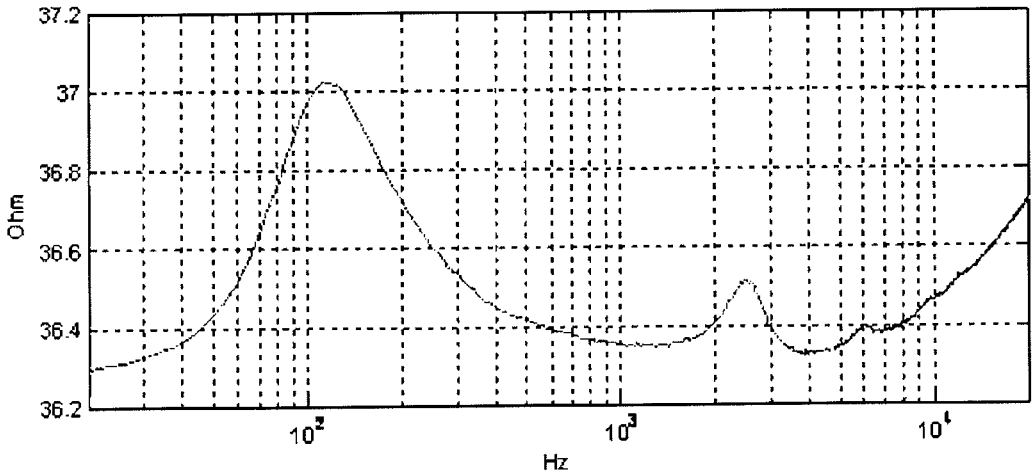
Figure 8:
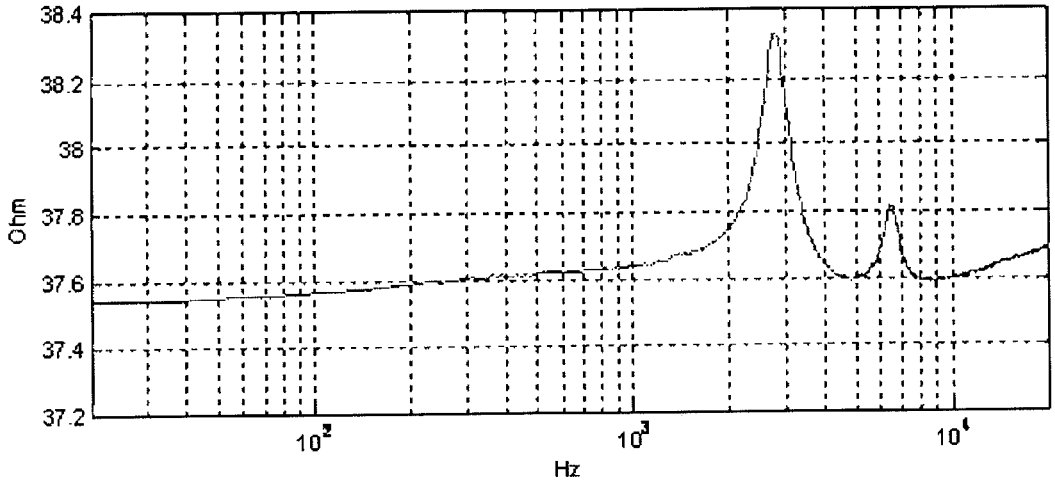

The impedance over frequency plot of an audio transceiver (i.e. speaker) is like a fingerprint, unique for products and typical for product types. As mentioned above, there are significant differences between the impedance of an in-concha ear speaker and an in-ear ear speaker. FIGS. 5-8 show some examples of speaker fingerprints. FIG. 5 shows the impedance as a function of frequency of an in-ear speaker. Please note the peak around 3000 kHz. This is typical for an in-ear speaker. FIGS. 6 and 7 show fingerprints of two in-concha speakers of different manufacturers. The fingerprints of FIGS. 6 and 7 do globally correspond but differ near the higher frequencies, see above 1 kHz. FIG. 8 shows a fingerprint of another in-ear speaker, which is different from the one shown in FIG. 5.

It should be noted that the invention is not restricted to the identification of ear speaker, nor to the use of mobile audio devices. The invention may as well be implemented in other audio devices which can be connected to (non-ear) speakers, such as headphones and loud speakers. Such speakers also have their unique impedance plot.

All parts of the fingerprints could be used to distinguish between the speakers connected to the audio device 1. For a relatively simple analysis, it could be enough to find the region for the fundamental resonance of the speaker. Also other parts of the fingerprint might be used. There are for example a lot of resonances in the high frequency region in many ear speakers. These might be used for identification even if they are not a part of the fundamental resonance. There might also be characteristic humps or phase shifts anywhere in the frequency band, and if they are typical enough they might be used for speaker identification.

The impedance measurement gives amplitude and phase for (normally) the audio range. To be able to distinguish between two very similar products the processor according to an embodiment, is arranged to analyze small differences almost in the measurement noise floor, i.e. the resolution of the measurement system.

The information on the identity of the speaker(s) is not only usable for optimizing the audio quality. Once the connected speaker 7 has been identified, its identity may be communicated via the sender/receiver 20 to the remote server 22. In this way, information on which speakers are used by several users can be gathered. Marketing people would like to know what the user is using, so some benefits can be connected and included in the sales item.

The possibility to distinguish what speaker is connected could be used for cost savings. For a new speaker, the requested performance could be achieved by a combination of a certain quality of the speaker and an audio device having compensation functionality. Here, by the requested performance is meant the audio quality, both objective and subjective. A manufacturer may be would like to sell a speaker at a certain price level, to keep good value for money. The objective performance (frequency response, phase response, dynamic range, distortion, rub and buzz, etc.) of such a speaker could be set at different target levels for different products; high requested performance for an expensive product and vice versa. The lower performance of a relatively cheap speaker could then at least partly be restored by using the compensation method described above.

According to an embodiment, the analysis of the fingerprints of the speakers is performed using the audio signals sent by the audio player 2, e.g. meaning standard music. A typical measurement range would be between 20 Hz to 20 kHz depending on the source material. If the played audio only is e.g. a bird song, there will not be much information about low frequency impedance. If the audio device 1 is a voice phone only, limited to voice bandwidth, there will only be information in the voice band 300-3400 Hz.

There are also typical limits for the audio device 1 itself. Normally the audio player 2, the filter 30, the converters 11,12 and the power amplifier 3 are only intended for audio, limiting the impedance measurements to the audio band.

To avoid the problems of the limited available frequency band, the audio device 1 according to an embodiment, comprises dedicated impedance measurements means arranged to measure at higher frequencies, beyond the audio band.

Please note that the dynamics of the impedance measurements will be determined by the resolution in the A/D converters 11,12 used. If the A/D converters 11, 12 are convertors intended for high quality audio recording, the resolution will be 16 or 24 bit, which is a high quality standard today.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof. Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

The foregoing has described the principles, preferred embodiments and modes of operation of the present invention. However, the invention should be regarded as illustrative rather than restrictive, and not as being limited to the particular embodiments discussed above. The different features of the various embodiments of the invention can be combined in other combinations than those explicitly described. It should therefore be appreciated that variations may be made in those embodiments by those skilled in the art without departing from the scope of the present invention as defined by the following claims.

The invention claimed is:

1. An audio device comprising:

an audio source arranged to produce audio signals;

an audio output arranged to connect at least one speaker with said audio device;

a memory having stored therein a plurality of identification data, each of the plurality of identification data corresponding to a different reference speaker;

an impedance calculation module arranged to calculate an impedance of said at least one speaker, the at least one speaker having an identity;

a speaker identification module arranged to determine the identity of said at least one speaker from a plurality of different speaker identifies using said calculated impedance and the plurality of identification data; and an audio compensation module arranged to compensate said audio signals in accordance with an impedance profile of said determined speaker identity to improve audio quality of sound output by said at least one speaker when driven by said compensated audio signals.

2. The audio device according to claim 1, wherein said audio compensation means comprises a spectral filter.

3. The audio device according to claim 1, wherein said device further comprises:

measuring means for measuring low frequency responses;

messaging means for creating an audio message in case the low frequency responses indicate a poor fit of the at least one speaker in a users ear.

4. The audio device according to claim 1, wherein said device further comprises storing means arranged to store said identification data.

5. The audio device according to claim 1, wherein said device further comprises receiving means arranged to receive at least part of said identification data of said reference speakers from a remote server.

6. The audio device according to claim 1, wherein said device further comprises sending means arranged to send said speaker identity to a remote server.

7. The audio device according to claim 1, wherein said device further comprises a resistor electronically connected between said audio source and said audio output, wherein said impedance calculation means are arranged to measure a voltage across and a current through said resistor.

8. The audio device according to claim 1, wherein the audio device is a mobile phone.

9. The audio device according to claim 1, wherein the audio compensation module is arranged to alter said audio signals output by said audio source to compensate for an audio characteristic output by said at least one speaker when driven by said altered audio signals.

10. An audio producing method comprising:

producing audio signals using an audio source;

obtaining a plurality of identification data, each of the plurality of identification data corresponding to a different reference speaker;

calculating an impedance of at least one speaker connected to an audio output for said audio signals, the at least one speaker having an identity;

identifying said identity of said at least one connected speaker from a plurality of different speaker identifies using said calculated impedance and the plurality of identification data; and compensating said audio signals by processing said audio signals in accordance with an impedance profile of said identified speaker identity to improve audio quality of sound output by said at least one identified connected speaker when driven by said compensated audio signals.

11. The method according to claim 10, wherein compensating said audio signal includes altering said audio signals to compensate for an audio characteristic output by said at least one speaker when driven by said altered audio signals.

* * * * *